United States Patent [19]

Murai et al.

[11] 4,438,701

[45] Mar. 27, 1984

[54] TRUCK CONVEYOR

[75] Inventors: Masasumi Murai; Hirokazu Kondo, both of Tokorozawa; Shigekatsu Takino, Hanno, all of Japan

[73] Assignee: Tsubakimoto Chain Company, Osaka, Japan

[21] Appl. No.: 348,671

[22] Filed: Feb. 16, 1982

[30] Foreign Application Priority Data

| | | | |
|---|---|---|---|
| Feb. 20, 1981 | [JP] | Japan | 56-22078[U] |
| Feb. 25, 1981 | [JP] | Japan | 56-24486[U] |
| Feb. 27, 1981 | [JP] | Japan | 56-26164[U] |

[51] Int. Cl.[3] ..... B61B 10/04

[52] U.S. Cl. ..... 104/172 B; 104/140

[58] Field of Search ..... 104/172 B, 172 S, 170, 104/146, 140

[56] References Cited

U.S. PATENT DOCUMENTS

| | | | |
|---|---|---|---|
| 3,518,946 | 7/1970 | Kavieff | 104/172 B |
| 3,774,546 | 11/1973 | Krammer | 104/172 S |
| 3,874,304 | 4/1975 | Robert | 104/172 S |
| 3,882,793 | 5/1975 | Wakabayashi | 104/172 B X |

FOREIGN PATENT DOCUMENTS

| | | | |
|---|---|---|---|
| 47-38391 | 9/1972 | Japan | 104/172 B |
| 53-15272 | 5/1978 | Japan | 104/172 B |
| 53-15273 | 5/1978 | Japan | 104/172 B |
| 55-40145 | 3/1980 | Japan | 104/172 B |
| 1351759 | 5/1974 | United Kingdom | 104/172 S |

*Primary Examiner*—Randolph Reese

*Attorney, Agent, or Firm*—Dann, Dorfman, Herrell and Skillman

[57] ABSTRACT

A truck conveyor for conveying an article along a selected conveyance path is provided. The truck conveyor includes a series of trolleys which are guided along a trolley rail. An article carrier for receiving articles is connected with the series of trolleys for conveying an article along the rail. A drive mechanism engageable with the trolleys is provided for conveying the trolleys and the article carrier along the rail. A device is provided at the rear of a stopped carrier to automatically disengage the drive mechanism from the trolleys of a trailing carrier when it is carried toward engagement with the stopped article carrier.

7 Claims, 7 Drawing Figures

TRUCK CONVEYOR

FIELD OF THE INVENTION

This invention relates to a truck conveyor suitable for carrying on a truck an article longer than the truck and capable of storing trucks while preventing a rear-end collision with a succeeding truck and further capable of conveying trucks exactly along a predetermined path.

BACKGROUND OF THE INVENTION

Truck conveyors for conveying long articles have heretofore been known, such as those described in Japanese Patent Publications Nos. 38391/72, 15272/78 and 15273/78.

In the truck conveyor disclosed in the Japanese Patent Publication No. 38391/72, a plurality of trolleys (four trolleys in the embodiment shown therein) are connected to one another through a traction bar (40) to constitute a traction trolley unit. The overall length of this traction trolley unit is made a little longer than the length of an elongated article carried on a truck (10) by either increasing the number of trolleys or selecting a suitable length of a traction bar according to the length of the elongated article. It is thereby possible to stop and store the truck even on a curved conveyance path without a succeeding truck colliding with the rear end of the stopped preceding truck. It is also possible to separate only the traction unit from the truck and lead it to a traction trolley unit storage path.

However, the overall length of the traction trolley unit, consisting of plural trolleys connected together through a traction bar, must be adjusted by either increasing the number of trolleys or selecting a suitable traction bar from among traction bars of various lengths according to the length of the elongated article to be conveyed. Additionally, for storing the traction trolley unit having a length greater than the elongated article to be conveyed, an increase in the length of the storage path is unavoidable. Moreover, as a spacer bar is provided between a trolley rail and a chain carrier rail of the trolleys, the distance between the two rails must be large.

In the truck conveyors disclosed in Japanese Patent Publications Nos. 15272/78 and 15273/78, a leading trolley (14) positioned in front of a truck and a rearmost trolley (15) positioned behind the truck are each connected directly to the truck (7) through universal joints and a spacer bar (12). Only the leading trolley (14) and the rearmost trolley (15) are guided within a rail (3), and therefore the direction of the truck cannot be controlled unless there is a rail (4) for guiding the running direction of the truck. Particularly on a curved path, it is possible that the centrifugal force acting on the truck will cause the truck to go off a predetermined running path, thus resulting in the spacing between the leading trolley (14) and the rearmost trolley (15) being shortened and the function of preventing a rear-end collision being no longer attainable. Moreover, whenever a flange is provided on a wheel, or the rail includes a channel for guiding the truck, the guide portion for the flange or the channel becomes an obstacle at the switch rail portion provided in the truck path switching position. Furthermore, by disconnecting the truck from the trolleys and removing it from its running path, it is necessary to remove the spacer bar (12) by removing connection pins. In addition, since the spacer bar protrudes upwardly from the floor on which the trucks move during the traction operation, personnel are liable to trip over it or articles conveyed on the floor are liable to collide with it rendering the trucks inoperative.

SUMMARY OF THE INVENTION

The present invention provides a single conveyor arrangement having improved means to couple and uncouple trolleys from the drive mechanism.

In accordance with the present invention, the truck conveyor comprises a leading trolley having pusher-engagement means, a front trolley, and a first spacer bar connecting the leading trolley with the front trolley. The spacer bar includes universal joints intermediate the leading and front trolleys to enable movement along a curved path. The truck conveyor also includes a rear trolley, a rearmost trolley having pusher-displacement means, and a second spacer bar connecting the rear trolley with the rearmost trolley. The second spacer bar also includes universal joints intermediate the rear and rearmost trolleys. A trolley rail is provided for guiding the leading, front, rear and rearmost trolleys along a selected conveyance path. The leading, front, rear and rearmost trolleys include rail-engagement means for engaging the trolley. An article carrier is also provided for receiving articles for conveyance. The article carrier includes first trolley engagement means at the front and thereof for detachably engaging the front trolley. The article carrier also includes second trolley engagement means at the rear for detachably engaging the rear trolley. Drive means is provided for advancing the article carrier and the leading, front, rear and rearmost trolleys along the trolley rail. For this purpose, in selected embodiments of the invention, the drive means includes pusher means having an operative position engagable with the pusher-engagement means of the leading trolley to effect conveyance and in inoperative position not engagable with the pusher-engagement means. The pusher-displacement means of the rearmost trolley is operable to engage and displace the pusher means into the inoperative position.

In an alternative embodiment, the truck conveyor comprises a single arrangement, but the pusher-engagement means of the leading trolley has an operative position engagable with the pusher means to effect conveyance and an inoperative position not engagable with the pusher means of the drive means and the truck conveyor includes pusher-disengagement means engageable with the pusher-engagement means for displacing the pusher-engagement means into said inoperative position.

The present invention, which eliminates the aforesaid drawbacks associated with the prior art, will be described hereinunder with reference to the accompanying drawings.

BRIEF DESCRIPTION OF THE DRAWINGS

The accompanying drawings illustrate embodiments of this invention, in which.

DETAILED DESCRIPTION OF THE INVENTION

Figure 1:
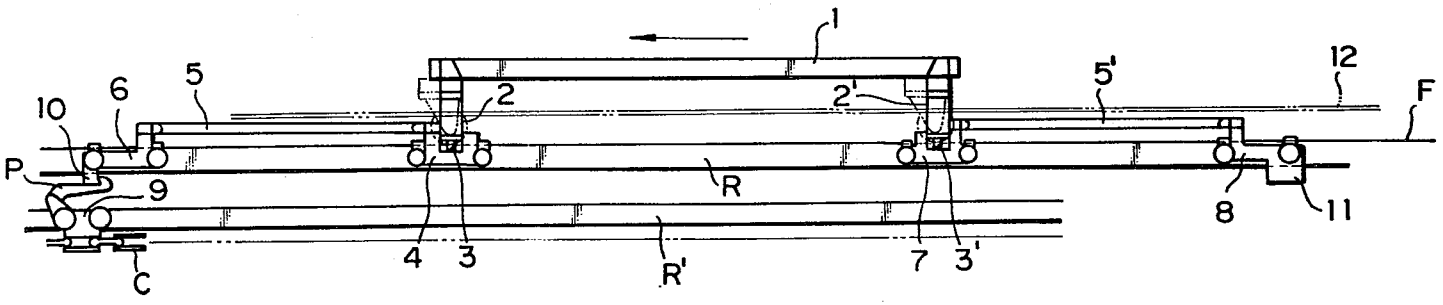
FIG. 1 is a front view of a truck conveyor of the present invention, illustrating the relationship of engagement between a truck and trolley units.
Figure 2:
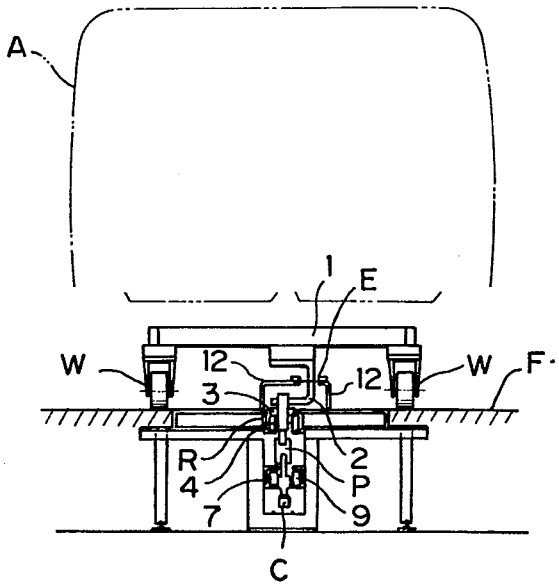
FIG. 2 is a transverse view of the conveyor shown in FIG. 1.
Figure 3:
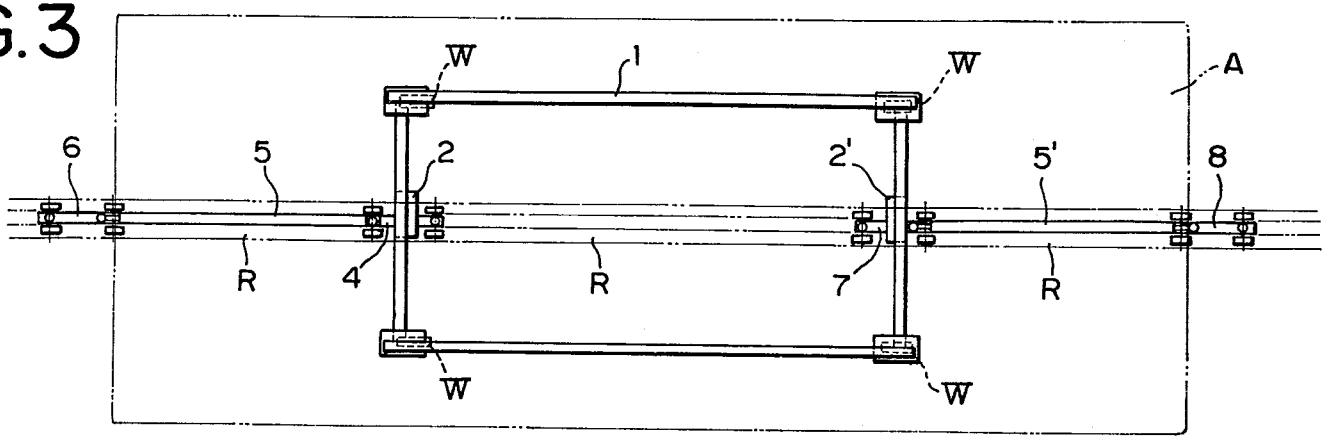
FIG. 3 is a plan view of the conveyor shown in FIG. 1.
Figure 4:
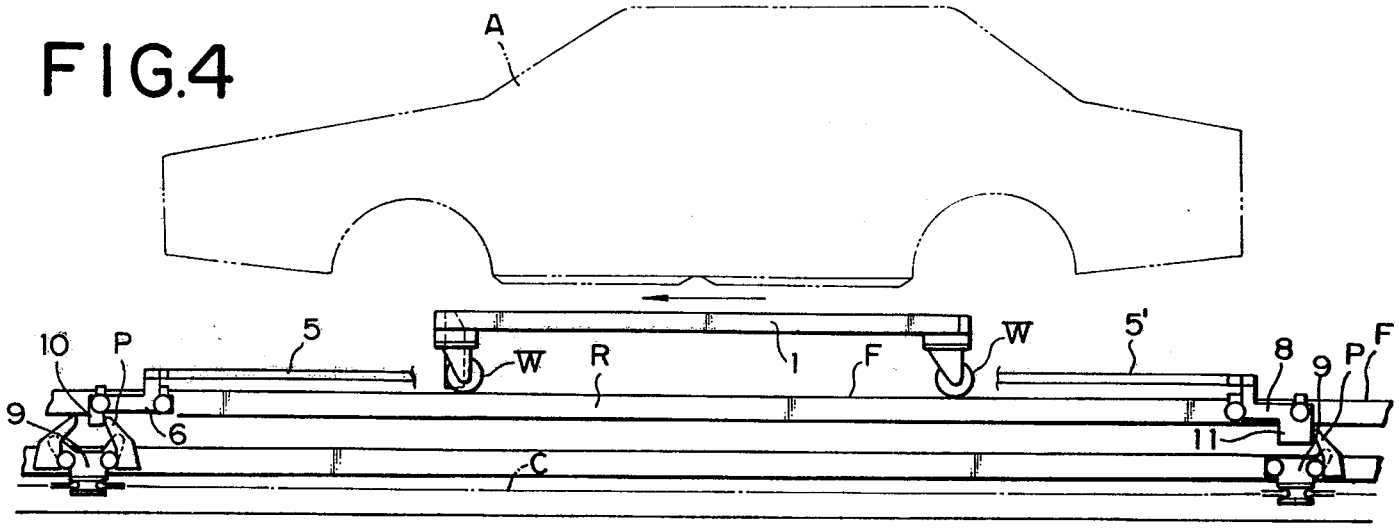
FIG. 4 is a front view showing another embodiment of a pusher in a truck conveyor of the present invention, with the trolley units being partially broken away.

As shown in FIGS. 1–4, at the four corners of a long article conveying truck 1 there are mounted swivel wheels W, and between both front swivel wheels and between both rear swivel wheels there are on the under surface of the truck, dependent first and second trolley-engagement means, respectively. For this purpose front and rear channeled engaging members 2 and 2' which are sidewardly opening with ]-shaped sections are adapted to engage front and rear trolleys, respectively, so that there remains a gap or clearance between the floor and the engaging members. As illustrated in FIG. 2, the front and rear channeled engaging members include vertically-disposed web portions with upper and lower horizontal flanges projecting laterally and outwardly therefrom to the left. On the lower sides of the engaging members 2 and 2' guide rollers 3 and 3' respectively are mounted so that they can rise and fall only in the longitudinal direction.

In an open channel in a running floor F for the truck 1 there is laid a trolley running rail R having ]-shaped rail portions including vertically oriented web members with horizontal flanges projecting to the left and to the right, respectively, the rail portions being disposed so that the respective opening portions are opposed to each other. On the rail R there are guided a front-side trolley unit and a rear-side trolley unit, the front-side trolley unit comprising a front trolley 4 having a recess for receiving the engaging member 2 and a leading trolley 6 connected to the trolley 4 through universal joints and a spacer bar 5. The rear-side trolley unit comprises a rear trolley 7 having a recess for receiving the engaging member 2' and rearmost trolley 8 connected to the trolley 7 through universal joints and a spacer bar 5'. The spacer bars 5 and 5' may be accommodated within the trolley running rail R and should the spacer bars be excessively long, it is possible to facilitate a smooth running of the trolleys in a curved path by providing swivel joints midway. The rail portions include upper slot-defining edges disposed in an opposing manner so as to define a slot therebetween. The guide rollers 3 and 3' are positioned between the opposed upper slot-defining edges of the running rail R and they guide the truck 1 along the running rail R while abutting those upper edges which are disposed within the same plane as the floor F. The trolleys 4, 6, 7 and 8 include wheels serving as rail-engagement means engaging the running rail R, and adapted to roll along the flanges thereof.

Figure 5:
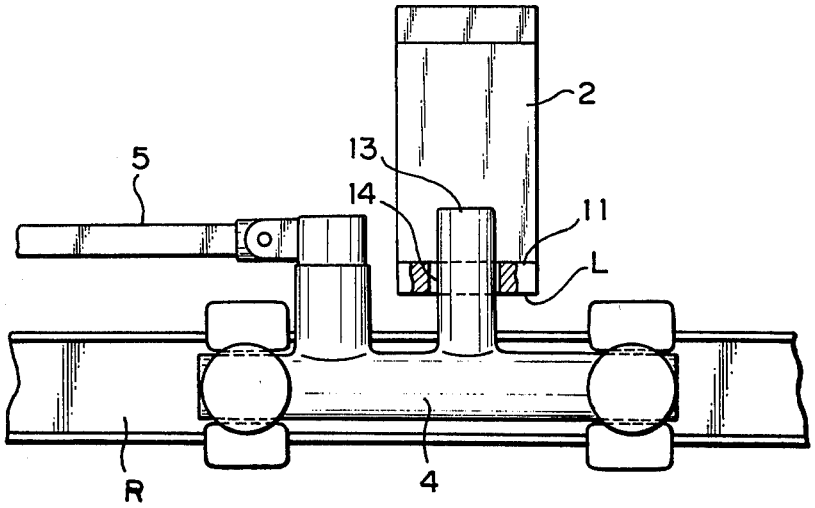
FIG. 5 is an enlarged front view of another embodiment of an engaging member.

Furthermore, instead of the recess in the foregoing embodiment, upstanding pins 13 and 13' may be provided in the front trolley 4 and rear trolley 7 respectively as shown in FIG. 5, which pins can be inserted into pin holes 14 and 14' provided in a lower member L of the engaging members 2 and 2'. In this case, the truck 1 can be guided along the running rail R without using the guide means such as the guide rollers 3 and 3' in the foregoing embodiment.

Under the trolley running rail R there is stretched a driving chain C which function as drive means to which is attached a carrier 9 having pusher means or pusher P. From the leading trolley 6 there depends pusher-engagement means such as a pusher plate 10 for engagement with the pusher P to effect conveyance or allowance of the truck along the rail R. From the rearmost trolley 8 there depends pusher-displacement means such as pusher actuator or displacement means 11 for depressing the pusher P for a succeeding front trolley unit to disengage it from the pusher plate 10. The pusher is provided on a carrier 9 guided along a carrier running rail R'. The pusher has an operative position in engagement with the pusher plate 10 and an inoperative position out of engagement with the pusher plate 10.

Figure 6:
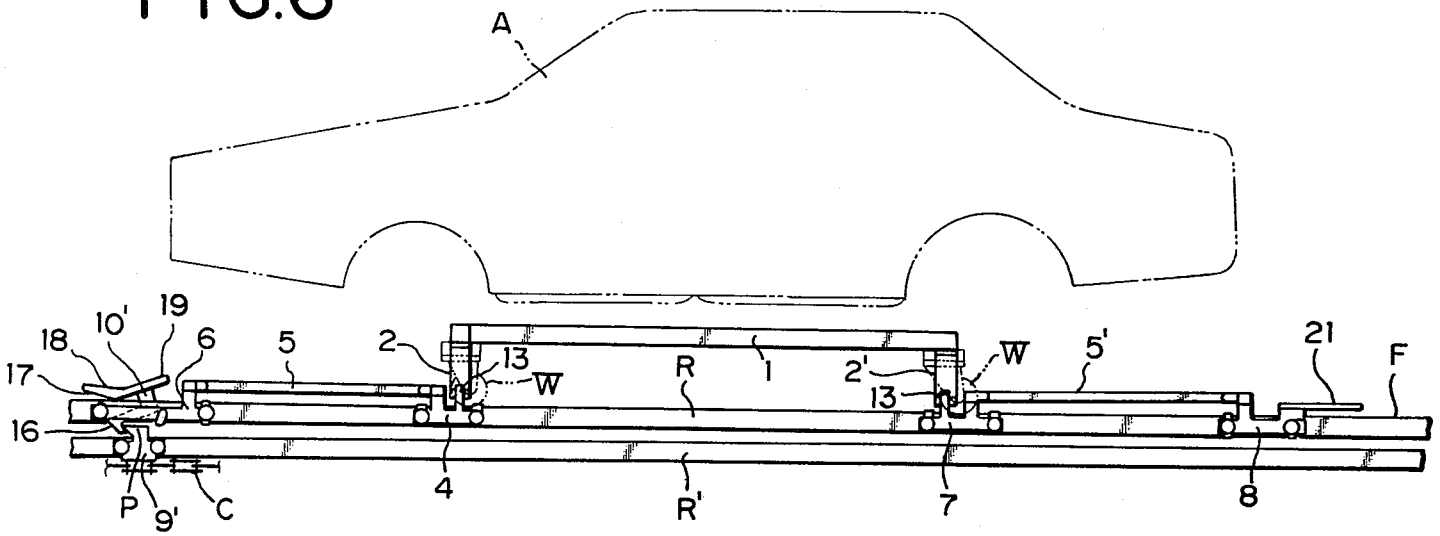
FIG. 6 is another embodiment of engagement/disengagement mechanism of a trolley and carrier.
Figure 7:
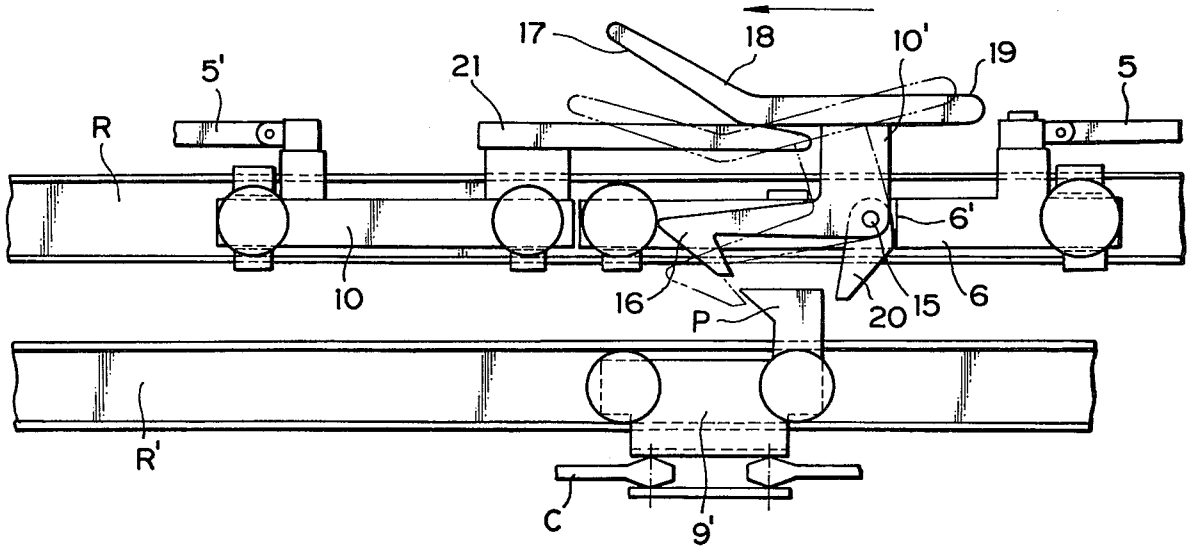
FIG. 7 is an enlargement of the principal portions of the truck conveyor shown in FIG. 6.

Moreover, as illustrated in FIGS. 6 and 7, in order to facilitate engagement/disengagement between pusher P and pusher plate 10 and to facilitate performance of this function on the floor, pusher P may be fixed to carrier 9' and a lever 10' may be pivotally provided to the frontmost trolley 6.

As shown on a larger scale in FIG. 7, a lever 10' is attached to the leading trolley 6 pivotally through a pin 15 and it is provided at its lower end with a hook 16, the hook 16 being adapted to engage a pusher P which is fixed to a driving chain C for movement within a carrier guide rail R' thereby pulling forward the leading trolley 6 to advance the truck 1. The lever 10' is also provided at its upper front end portion with a sensor bar 18, the sensor bar 18 having a lower surface 17 which has a forwardly rising gradient, and further provided at its upper rear end portion with a treadle portion 19. Behind the pin 15 on the leading trolley 6 there is formed a vertical wall 6' which projects from the leading trolley. The back of a pivoted retainer dog 20 may abut the vertical wall 6' so as to be pivotable on the pin 15 only in the advancing direction of the leading trolley (clockwise in FIG. 7).

A rearwardly projecting cam rod 21 serving as pusher-disengagement means is fixed to the rearmost trolley 8 and, as shown in FIG. 7, when the leading trolley of a succeeding truck approaches the rearmost trolley of a preceding truck, the cam rod 21 of the rearmost trolley comes into abutment with the lower surface 17 of the sensor bar 18 of the leading trolley and moves therealong to upwardly displace the sensor bar 18 from an operative position indicated in broken lines to an inoperative position indicated in solid lines, so that the hook 16 is disengaged from the pusher P in the inoperative position and the succeeding trolley stops without rear-end collision with the preceding trolley.

Even when the succeeding trolley does not approach the preceding trolley, if the treadle portion 19, also serving as pusher-disengagement means, of the sensor bar 18 is depressed, the sensor bar 18 moves pivotally from the operative position shown in broken lines to the inoperative position shown in solid lines, thereby allowing the hook 16 to be disengaged from the pusher P in the inoperative position, and thus the succeeding trolley can be stopped at any desired position by depressing the treadle portion 19 of the sensor bar 18. If the treadle portion 19 is extended backward from the upper rear end portion of the sensor bar, the treading operation becomes easier and more certain.

In a truck running path where dust or paint overspray is produced in a painting line, it is necessary to prevent such paint or other dust from entering and adhering to the running rail R, the carrier 9 and the driving chain C. For this purpose, as illustrated in FIGS. 1 and 2, covering means such as a slotted cover plate 12 of a desired length is mounted upright on the truck running floor F, the cover plate 12 having an elastic piece E attached to its slot-defining edges for sealing the moving path of the vertically-oriented web portion of the ]-shaped engaging member (see FIG. 2), whereby the movement of the trolley, carrier and chain is made smooth and the rise and fall motion of the pusher is ensured. The vertical web portion of the engaging members 2 and 2' are disposed within the slot of the cover plate between the opposing slot-defining edge thereof.

The chain C, which is driven by a motor, pulls the leading trolley 6 by engagement with the pusher P thereby moving the truck 1 which carries an elongated article A thereon along the trolley running rail R. In this case the front trolley 4 and the rear trolley 7 engage and travel upon the lower flanges of the ]-shaped engaging members 2 and 2' respectively, to thereby move the truck 1, while the guide rollers 3 and 3' ride between the upper flanges of the opposed trolley running rail R to suppress the rolling of the truck 1. Therefore, unlike the truck conveyors disclosed in the foregoing Japanese Patent Publications Nos. 15272/78 and 15273/78, it is not necessary to restrict the moving path of the truck itself by laying a U-shaped rail on the truck running floor F or by providing a wheel flange which is guided by an I-shaped rail. Consequently, even if swivel wheels capable of running freely on the floor are attached to the truck, it is not likely at all that the truck would go off a curved path of conveyance; and the truck can move on the trolley running rail R along a predetermined conveyance path.

Moreover, since the engaging member 2 and 2' of the truck are merely fitted disengageably in the recesses of the front and rear trolleys 4 and 7, respectively, the mounting and removal of the front- and rear-side trolley units with respect to the truck 1 are extremely simple and easy. Besides, since the front- and rear-side trolley units have only a length extending forward from the front end of the truck and a length extending backward from the rear end of the truck, respectively, without an intermediate portion, the length of those trolley units can be shortened to a remarkable extent as compared with the truck conveyor disclosed in the foregoing Japanese Patent Publication No. 38391/72. Furthermore, the removal of the trolley units is extremely easy as compared with the truck conveyors disclosed in the foregoing Japanese Patent Publications Nos. 15272/78 and 15273/78.

In this invention, as will be apparent from the above description, the front-side trolley unit consisting of the leading trolley and the front trolley is engaged detachably with the engaging member dependent from the front end portion of the truck, while the rear-side trolley unit consisting of the rear trolley and the rearmost trolley is engaged detachably with the engaging member dependent from the rear end portion of the truck, whereby the length of the trolley units can be remarkably shortened. Therefore, the storage or housing area of the trolley units can be reduced to a large extent. Moreover, since the truck has two trolleys in front and also two trolleys in the rear, it will never run off the predetermined conveyance path no matter whether the conveyance path may be rectilinear or curved. Furthermore, the spacing between the leading trolley and the rearmost trolley is not shortened and so the function of preventing a rear-end collision is not lost. It is also not necessary to lay a truck-wheel-guiding rail on the floor or form a wheel flange for restricting the running direction of the truck. Therefore, even when conducting the truck from the main conveyance path to a branch path, it is not necessary to provide a special means on the floor for conducting the truck itself. Since the truck, once disconnected from the trolley units, can run freely on the floor, it can be moved to any desired place and thus an efficient utilization of the truck is attainable. Furthermore, the vibration in the transverse direction of the truck is restricted by the front- and rear-side trolley units, so even if the truck tries to run in reverse, the swivel wheels turn sideways to prevent the reverse movement of the truck.

As set forth hereinbefore, according to this invention as compared with conventional constructions, a large saving in the trolley unit storage or housing area is attainable because the trolley units can be shortened, and without specially laying a truck guiding rail the truck can be advanced without running off a predetermined conveyance path even if this path is curved while suppressing the rolling of the truck by means of the rear-side trolley unit, and the truck itself once disconnected from the trolley units can move freely on the floor. Furthermore, the mounting and removal of the trolley units with respect to the truck is so easy that the conveyance work by the truck conveyor can be made highly efficient.

Moreover, it is apparent that the spacer bars 5 and 5' of the front- and rear-side trolley units both can be accommodated within the trolley running rail R so as not to project outside this rail. In that case, should the spacer bars be excessively long, it is possible to facilitate a smooth running of the trolleys in a curved path by providing swivel joints midway of the spacer bars. Therefore, it is not likely that a worker will stumble over those spacer bars or that an article being conveyed on the floor will strike against them thereby making the trolleys unmovable. A safe and smooth movement of the carrier can be ensured.

If the thickness of each spacer bar is made smaller than the spacing between the opposed ]-shaped trolley running rail portions, the spacer bars when moving on a curved up-and-down path form a chord extending outward from the said opposed gap of the rail, thus permitting the truck to move smoothly on such a curved up-and-down path. While on a horizontally curved path, it is possible for the truck to move smoothly without abutment of the spacer bars with the inner surface of the rail, if the width of the slot between the upper flanges of the inside ]-shaped trolley running rail portion is larger.

In addition, as set forth hereinbefore, a hook adapted to engage and disengage from the pusher of the driving chain is attached to the leading trolley and the engaging and disengaging operation for the hook is performed above the leading trolley, so that the engagement or disengagement between the hook and the pusher can be confirmed according to whether the sensor bar exposed on the floor is in a risen state or fallen state, and thus the confirmation is very easy. Moreover, by a mere operation of the treadle on the floor it is possible to engage and disengage the hook with respect to the pusher in any desired position, and thus the engaging and disengaging operation is very simple. Additionally, since the hook is formed at the lower end of a lever and the sensor bar is formed at the upper end of the lever, the pivotal radius of the lever arm becomes longer whereby the engaging and disengaging motion of the hook can be made larger to ensure the engagement and disengagement between the hook and the pusher. Thus, the present invention is of great utility value.

In this invention, as set forth hereinbefore, while the truck is pulled forward in its engagement with the trolleys, the pins projecting from the trolleys are inserted through the holes formed in the engaging members. The truck is then pulled by these pins while inadvertant rolling is prevented. Consequently, the structure of the trolleys does not become complicated and weight-saving is attainable. Furthermore, it is not necessary to provide on the floor a flanged rail for guiding the truck.

On the other hand, when disconnected from the front- and rear-side trolley units, the truck is carried on the floor movably by its wheels since the lower flange of the ]-shaped engaging member is positioned higher than the truck running floor, and therefore does not interfere with the free movement of the truck on the floor. Furthermore, the lower-side portions or flanges of the engaging members overlie the trolley running rail and the vertical web portions of the engaging members extend upwardly from the position just above the trolley running rail. Therefore, it is possible to prevent foreign matter from getting into the trolley running rail if cover means such as a cover plate has the desired length and has opposing slot-defining edges in proximity with the sides of said vertical web portions of the engaging members 2 and 2'. In such a position the cover means covers the running rail R disposed within the floor.

What is claimed is:

1. A truck conveyor comprising:

a leading trolley;

a front trolley;

means connecting said leading trolley with said front trolley;

a rear trolley;

a rearmost trolley;

means connecting said rear trolley with said rearmost trolley;

a trolley rail for engaging and guiding said leading, front, rear and rearmost trolleys along a conveyance path;

an article carrier for receiving articles for conveyance having first trolley-engagement means at the front of said article carrier for detachably engaging said front trolley and second trolley-engagement means at the rear of said article carrier for detachably engaging said rear trolley;

said first and second trolley engagement means respectively comprising front and rear channeled engaging members having vertically oriented web portions and upper and lower horizontally disposed flanges defining for each engaging member a sideward opening and a ]-shaped cross section;

drive means for conveying said article carrier and said leading, front, rear and rearmost trolleys along said trolley rail;

drive-engagement means having an operative position connecting said leading trolley to said drive means to effect conveyance and an inoperative position disconnecting said leading trolley and said drive means to inactivate said conveyance; and drive disengagement means on said rearmost trolley operable to displace said drive-engagement means to said inoperative position.

2. A truck conveyor in accordance with claim 1 wherein said trolley rail is provided with a longitudinal opening and including cover means for said trolley rail opening having slot-defining edges defining a slot through said cover means, said slot-defining edges of said cover means being disposed in proximity to the opposing sides of the vertical web portions of said front and rear channel members.

3. A truck conveyor in accordance with claim 2 wherein said slot-defining edges of said cover means include elastic pieces contacting the opposing sides of the vertical web portions of the front and rear channeled engaging members.

4. A truck conveyor in accordance with claim 1 wherein the lower flanges of the first and second trolley-engagement means include means defining pin holes and are disposed vertically higher than the upper surface of the trolley rail, and wherein further said front trolley and said rear trolley include pins for insertion into said pin holes to effect engagement of said article carrier with said front and rear trolleys.

5. A truck conveyor in accordance with claim 1 comprising a series of carrier units, each unit having leading, front, rear and rearmost trolleys and an article carrier cooperable with said trolley rail and drive means, the leading trolley of each unit carrying a displaceable member of said drive-engagement means to effect conveyance of said unit, said drive-disengagement means of said rearmost trolley of one unit being operable to engage said drive-engagement means of the following unit of said series to displace said displaceable member of the drive-engagement means into said inoperative position.

6. A truck conveyor according to claim 1 wherein said drive means includes a displaceable member of said drive-engagement means, and said drive-disengagement means displaces said member of said drive-engagement means into said inoperative position.

7. A truck conveyor in accordance with claim 1 wherein said drive-engagement means includes a displaceable lever to displace said drive-engagement means between operative and inoperative positions, said drive-disengagement means being operable to engage said lever to effect displacement of said lever.

* * * * *